United States Patent [19]

Bordat et al.

[11] 3,977,348

[45] Aug. 31, 1976

[54] ADJUSTABLE HYDRODYNAMIC SECTION FOR SUBMERGED FOILS

[75] Inventors: André Jules Edmond Bordat, Paris; Michel Auguste Achille Pouillot, Lambesc, both of France

[73] Assignee: Societe Nationale Industrielle Aerospatiale, Paris, France

[22] Filed: May 16, 1975

[21] Appl. No.: 578,158

[30] Foreign Application Priority Data

May 21, 1974 France ..... 74.17578

[52] U.S. Cl. ..... 114/66.5 H; 244/42 D

[51] Int. Cl.[2] ..... B63B 1/22

[58] Field of Search ..... 114/66.5 H; 244/42 CA, 244/42 DA, 42 D

[56] References Cited

UNITED STATES PATENTS

| | | | |
|---|---|---|---|
| 1,818,309 | 8/1931 | De Villard | 244/42 CA |
| 1,878,775 | 9/1932 | Henry | 244/42 DA |
| 3,044,432 | 7/1962 | Wennagel et al. | 114/66.5 H |
| 3,139,059 | 6/1964 | Hanford, Jr. | 114/66.5 H |
| 3,812,806 | 5/1974 | Korotkov et al. | 114/66.5 H |
| 3,831,885 | 8/1974 | Kasper | 244/42 DA |

*Primary Examiner*—Trygve M. Blix
*Assistant Examiner*—Stuart M. Goldstein
*Attorney, Agent, or Firm*—Karl W. Flocks

[57] ABSTRACT

A submerged foil for a bearing hydrofoil adjustable for different speeds with a central portion, a pivotal bow flap, and two aft or trailing edge flaps with one above the other, and increasing thickness of the foil from its front to rear ends. Pressure sensors are located on the foil surface.

6 Claims, 7 Drawing Figures

ADJUSTABLE HYDRODYNAMIC SECTION FOR SUBMERGED FOILS

This invention relates to submerged foils for bearing hydrofoils, more particularly to a foil whose hydrodynamic section can be adjusted to provide a continuously variable behaviour in acceleration and deceleration through various speed ranges.

The bearing or lift for hydrofoils is of course provided by a submerged foil which is operative at some distance from the water surface and which may be operating in any one of three regimes, depending upon the speed of the hydrofoil. At subcavitating speeds the entire periphery of the foil is in direct contact with the water. At transcavitating speeds some parts of the flow become detached from the periphery and a cavity in which water is converted into vapour arises on the foil surface. At supercavitating speeds the foil operates with a permanent vapour cavity extending from the leading edge, and thickening, towards the trailing edge, the cavity possibly being disposed, depending on the angle of incidence of the foil, either on the top surface or the bottom surface of the section.

At transcavitating speed cavitation may arise at various places on the surface, but tends to be more particularly a phenomenon starting in the relatively thick zone of the section. Cavitation of this kind, known as "thickness cavitation", and cavitation arising at the leading edge, are the main operating conditions at cavitating speeds.

The lift or bearing means for a hydrofoil must therefore not only enable the hydrofoil to operate in the three cavitating conditions referred to but must also make possible a transition between the conditions without disturbance to the general stability of the craft and without the bearing surfaces being damaged inter alia by vapour hammering.

A number of solutions have been suggested to solve these problems. U.S. Pat. No. 2,890,672 discloses inter alia a system comprising three sorts of foils rigidly secured to one or more brackets or struts or the like, to obviate the risk of random cavitation and to enable the craft to operate in the three cavitation conditions referred to. The foils, which each have a section adapted for operation in a particular range, emerge from the water in proportion as speed increases, so that the foils not adapted to operating conditions at a particular speed become inoperative.

Of course, with a system of this kind, the hydrofoil can operate only in particular speed and immersion conditions. Also, disturbances may arise at transitions from one foil to another, particularly if the foils which have emerged from the water behave like aerodynamic sections and thus provide a secondary lift and drag which must be considered in deciding on the dimensions of the support members and on the general stability of the craft.

To obviate having a number of bearing foils and the associated disadvantages, the invention provides an adjustable foil which is instantaneously adaptable to the operating conditions associated with the selected speed.

Hydrodynamic sections having flaps either at the leading edge or at the trailing edge or at both are known and are usually designed to operate fully retracted at low speeds where there is no random cavitation.

In subcavitating conditions the or each trailing-edge flap can modify the camber of the foil in dependence upon speed to provide a constant bearing or lift without causing unstable flow. However, when the flow around the section reaches such a pressure, e.g. in the top of the section, that cavitation at the top of the section may start at any time, such cavitation is triggered prematurely by moving the leading-edge flap into an operative position. This step prevents unstable uncontrolled flow on the foil surface and locates the vapour cavity with its origin at the leading edge throughout the supercavitating speed range.

Various suggestions have been made for transcavitating or intermediate conditions. Some systems use a set of flaps which move in a combined translational and rotary movement to produce a secondary flow on the bottom of the foil thus providing by entrainment the partial control of the primary flow on the top of the section and of the general lift or bearing provided by the foil. It is also known to use air jets arranged appropriately around the section to cause and locate the cavitation space at particular spaces.

This invention relates to a hydrofoil foil which can operate immersed at various speeds and which has a novel system of flaps at its trailing edge, which system, by altering the hydrodynamic section, is a means of triggering and controlling cavitation in the transition zones, particularly in the case of thickness cavitation, while retaining the possibility of altering or not the hydrodynamic bearing or lift.

According to the invention, in an adjustable hydrodynamic-section foil having at the front a front orientable flap adapted to cause cavitation originating at the leading edge and having at the back an aft camber-changing flap for modifying and controlling the hydrodynamic lift or bearing in various conditions of operation, the aft camber-changing flap co-operates with an auxiliary flap adapted to initiate or obviate thickness cavitation and also co-operating with the camber-changing flap to alter the shape of the section in subcavitating and transcavitating conditions.

The following description, taken together with the accompanying drawings, will show how the invention can be carried into effect.

Figure 1:
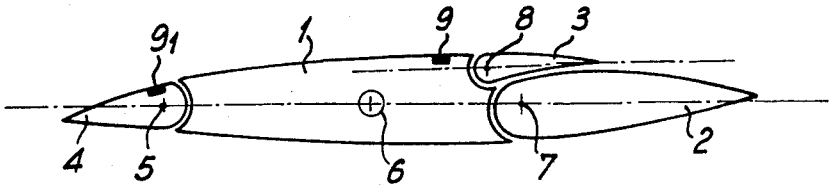
FIG. 1 is a view in cross-section of a foil, which in plan can be of any shape, according to the invention.

FIG. 1 is a view of a preferred form of adjustable foil section according to the invention. The foil has on either side of a central portion 1, a bow or leading-edge flap 4 and two aft or trailing-edge flaps 2, 3 which are placed upon another. Through the agency of a transverse articulation diagrammatically represented by a pivot 6, a desired angle of incidence can be imparted to the central part 1. The same has towards the rear, in the zone where its thickness starts to increase, a known pressure sensor 9 adapted to detect the pressure corresponding to the origin of a thickness cavitation.

The bow flap 4, which is orientable around a pivot 5, is faired externally so that when it is moved into an operative position it can locate the vapour cavity to start at the leading edge at supercavitating speeds. Operation of the bow flap 4 is also a means of providing some alteration in the camber of the section and to adapt it to operating conditions at subcavitating or transcavitating or supercavitating speeds. Like the central part 1, the bow flap 4 has a pressure sensor $9_1$ which in this case is disposed, preferably but not limitatively, on the top surface of the section to detect pressures in order either to prevent any accidental triggering of leading-edge cavitation or to trigger such cavitation.

At the trailing or after end of the section the flap 2, which is orientable around a pivot 7, can, in co-operation with the flap 3 which is adjustable around a pivot 8, act on the general camber of the section and inter alia, by being pivoted downwardly, can act as a means for keeping the hydrodynamic lift or bearing force constant in the different flight patterns.

Flap 3, which is preferably disposed on the top of the section above the flap 2, has a chord length less than that of flap 2 and can be controlled separately or together therewith. The flap 3, which is disposed immediately behind the pressure detector 9 in a zone where the relative thickness of the section with the flaps retracted is near its maximum value, can be pivoted rapidly upwards in order to increase the thickness of the section abruptly and thus trigger off thickness cavitation when the data obtained by sensor 9 make it seem likely that thickness cavitation is about to arise.

In an advantageous form of the section, with the flaps fully retracted the section has a thickness which increases progressively from the leading edge over more than at least half the distance of the total chord, the thickness then decreasing towards the trailing edge.

Other shapes of section are possible, particularly if operation is required only at subcavitating and transcavitating speeds, and such other sections can readily be provided with a combination of flaps for triggering thickness cavitation and for controlling lift at various places without departure from the scope of the invention.

A description of the operation of the section in the three ranges mentioned will show how each flap operates.

Figure 2:
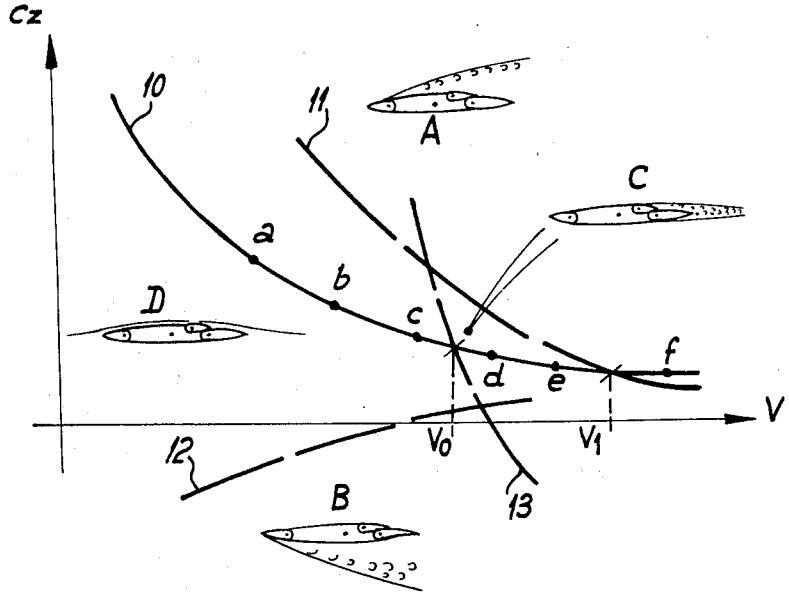
FIG. 2 is a diagram showing the various foil operating conditions and the speed/lift factor relationship for a section according to the invention.

Curve 10 in FIG. 2 shows the lift or bearing factor $C_c$ plotted against increasing speeds V for a given kind of section. The equation governing the curve 10, which is prepared for a constant given lift $F_z$, is:

$$C_z = \frac{2\,F_z}{\rho \cdot S} / V^2 \text{ or : } C_z = k / V^2 \text{ with } k = 2F_z / \rho \cdot S$$

in which $\rho$ is equal to the specific weight of the fluid and S represents the reference lift area of the foil.

FIG. 2 also shows four foil operating conditions separated from one another by curves 11, 12 and 13.

In operating condition A, whose bottom limit is the curve 11, cavitation is operative on the top of the section. In range B, whose top boundary is curve 12, there is cavitation on the bottom of the section. In range C, which is bounded on three sides by the curves 11, 12, 13, the section is operating in thickness cavitation conditions. In range D, which is also limited towards low speeds by the curves 11, 12 and 13, the section is completely immersed — i.e., it is operating in subcavitating conditions.

To clarify matters, the behaviour of the flow contacting the section, which is assumed to be of constant shape, is indicated beside the letters A, B, C and D.

The creation of the boundaries represented by the curves 11, 12 and 13 depends upon the pressure zone around the section and therefore directly on the shape thereof and of its orientation in the flow. Consequently, there are usually two critical speeds for any given kind of section — one critical speed $V_o$, determined by the intersection of curve 10 and of curve 13, at which thickness cavitation starts, and a critical speed $V_1$ determined by the intersection of curves 10 and 11, where cavitation starts on the back of the section with its origin at the leading edge.

To explain alterations of the profile for the various ranges, a number of points are plotted on curve 10; the points *a, b, c* are in subcavitating conditions, the points *d, e* are in transcavitating conditions and the point *f* is in supercavitating conditions.

Figure 3:
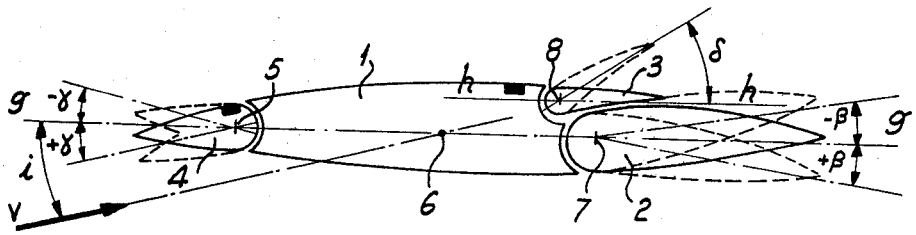
FIG. 3 shows in chain lines the possible movements of the flaps of the foil and the origins of such movements.

The various movements of the flaps correspond to FIG. 3 which shows with effect from the zero-lift chord *g — g* and from the parallel reference line *h — h* of the flap 3, the positive and negative inclinations $\beta$, $\delta$, $\gamma$ of the flaps 2, 3 and 4 respectively and the general angle of attack *i* of the section relatively to an upstream flow speed V of infinity.

Figure 4:
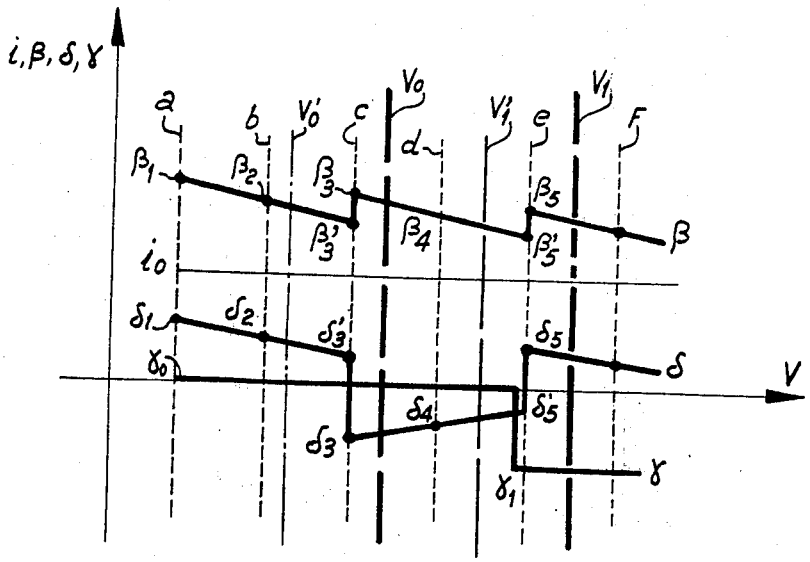
FIG. 4 is a diagram showing a possible scheme for variation of the angling of the various flaps in dependence upon increasing speeds.

In FIG. 4, possible variations in the inclinations *i*, $\rho$, $\delta$ and $\gamma$ with increasing speed are plotted on the ordinate and the two critical speeds $V_o$ and $V_1$ previously referred to are also shown.

After lifting-off the hydrofoil approaches subcavitating speeds with its foil set at an angle of attack $i_o$ thereafter assumed to be constant. At subcavitating speeds the flaps are in positions given at the point *a* by the positive inclinations $\beta_1$ for the camber-changing flap 2 and $\delta_1$ for the flap 3; the angle of attack of the bow flap 4 remains zero ($\gamma = 0$). As the craft increases its speed, these inclinations have to be altered if constant lift is to be maintained — i.e., if the water clearance is to remain the same. The angles $\beta$ and $\delta$ must therefore gradually decrease, and to reach the values $\beta_2$ and $\delta_2$ the hydrofoil passes through point *b* of subcavitating conditions to reach the values $\beta'_3$ and $\delta'_3$ at point C.

Figure 5:
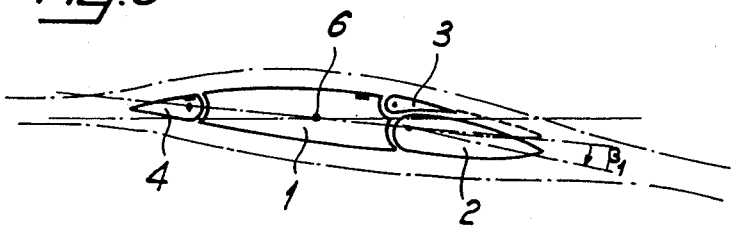
FIGS. 5, 6 and 7 show the position of the various flaps for operation of the section of FIG. 1 at subcavitating, transcavitating and supercavitating speeds.

Consequently, the profile has the configuration shown in FIG. 5 for subcavitating operation.

At point *c*, as the first critical speed $V_o$ is approached, the sensor 9 indicates that the foil is operating in conditions which might trigger thickness cavitation. To prevent accidental triggering of thickness cavitation flap 3 is inclined upwards abruptly and at the point *c* changes over from the positive value $\delta'_3$ to the negative value $\delta_3$. Simultaneously, flap 2 increases its positive inclination and takes up a position determined by the angle $\beta_3$. The co-ordinated and simultaneous angling of the flaps 2 and 3 helps to compensate for the loss of lift caused by the flow disturbance caused by flap 3 and is a means of locating the vapour cavity at the trailing edge.

Figure 6:
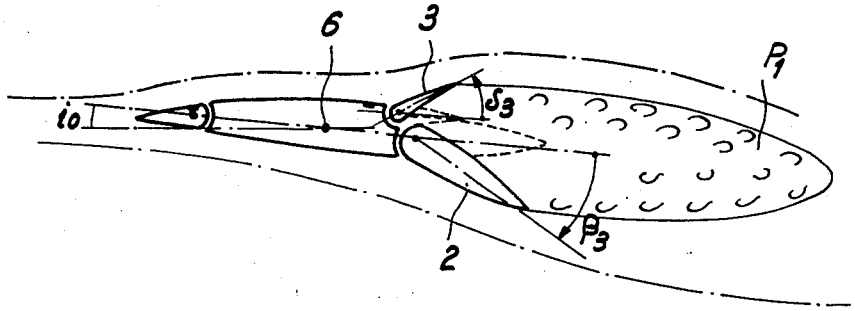

FIG. 6 shows such a vapour cavity $P_1$ with its two origins at the ends of the flaps 2 and 3.

As speed increases, the section can pass through the first critical speed $V_o$ with a completely stabilised aft vapour pocket. At these speeds, as in the previous speed range, the inclinations $\beta_3$ and $\delta_3$ must be reduced progressively — i.e., the thickness of the pocket must be reduced — for the sake of constant lift.

FIG. 4 accordingly shows how the values $\beta_3$ and $\delta_3$ decrease, passing at the point *d* through the values $\beta_4$ and $\delta_4$ and acquiring at point *e* in the same range the values $\beta'_5$ and $\delta'_5$.

Figure 7:
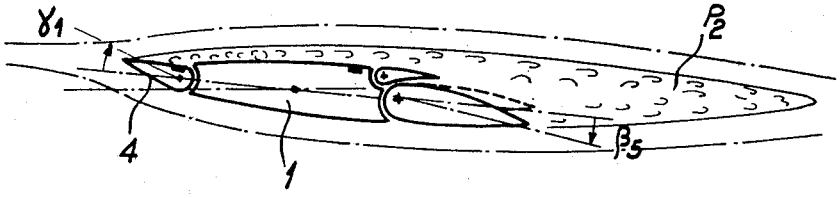

Having reached this speed range operative around the point *e*, the pressure sensor $\mathbf{9}_1$ detects the possible initiation of cavitations starting at the leading edge. To obviate any such spontaneous triggering and to prevent abrupt detachment of the pocket associated with the ends of the flaps 2 and 3, the bow flap 4 is at point *e* inclined for the first time by a negative quantity $\gamma_1$ (upwardly) to locate the cavitation on the top of the foil at the bow edge, in the manner shown in FIG. 7.

Simultaneously, to restore a general camber such as to obviate any variation in lift, the angle of attack of the flap 2 is increased from $\beta'_5$ to $\beta_5$ whereas the flap 3 returns from the negative value $\delta'_5$ to a positive value $\delta_5$ to take up a position inside the vapour cavity in a zone not disturbing the outside laminar flow.

The second critical speed $V_1$ is therefore passed through with complete control of cavitation so that the hydrofoil can move fast; the angles $\beta_5$ and $\delta_5$ are decreased progressively as speed increases to keep the hydrodynamic lift of the submerged foil constant all the time.

Of course, because of hysteresis the critical speeds $V_1$ and $V_o$ are different for decreasing speeds — i.e., for a given section of foil, the vapour cavities disappear at speeds below the speeds at which they appeared.

The reverse flap-inclining steps are performed at speeds lower than the new critical speeds $V'_1$ and $V'_o$ shown by way of example in FIG. 4 to make sure that when the operation is carried out the resulting flow conditions are correct for the speed range in which the hydrofoil is then operating.

Consequently, by having a combination of flaps at its after or trailing edge, the hydrodynamic section according to the invention is a means of enabling a hydrofoil craft to operate at high speeds, e.g. 110 kph, and to pass through the various cruising-range transitional zones under complete control.

We claim:

1. A hydrodynamic-section foil comprising a central portion having a section increasing in thickness from its front end towards its rear end, a first flap extending from and pivotally connected to the front end of said central portion to form a leading edge for the foil, said first flap being adapted to trigger cavitation from said leading edge of the foil, a second camber-changing flap, extending from and pivotally connected to the rear end of said central portion to form a trailing edge for the foil, said second flap being adapted to modify and control hydrodynamic lift or bearing of the foil in various operating conditions, and a third auxiliary flap for triggering or obviating thickness cavitation, said auxiliary flap having a shorter chord than said second flap and extending from and being pivotally connected to the rear end of said central portion above said second flap to cooperate therewith for altering the foil section shape in subcavitating and transcavitating conditions, the sum thickness of the respective sections of said second and third flaps decreasing towards the trailing edge of the foil from a maximum value substantially equal to the section of the rear end of said central portion.

2. A foil according to claim 1 wherein said second camber-changing flap and said third auxiliary flap are adapted to be operated in dependence upon information supplied by pressure sensors on the foil surface.

3. A hydrofoil comprising at least one adjustable hydrodynamic-section foil having a central portion with a section increasing in thickness from its front end towards its rear end, a first flap extending from and pivotally connected to the front end of said central portion to form a leading edge for the foil, said first flap being adapted to trigger cavitation from said leading edge of the foil, a second camber-changing flap, extending from and pivotally connected to the rear end of said central portion to form a trailing edge for the foil, said second flap being adapted to modify and control hydrodynamic lift or bearing of the foil in various operating conditions, and a third auxiliary flap for triggering or obviating thickness cavitation, said auxiliary flap having a shorter chord than said second flap and extending from and being pivotally connected to the rear end of said central portion above said second flap, to cooperate therewith for altering the foil section shape in subcavitating and transcavitating conditions, the sum of the respective sections of said second and third flaps decreasing towards the trailing edge of the foil from a maximum value substantially equal to the section of the rear end of said central portion.

4. The hydrofoil according to claim 3, further characterized by said first flap, said central portion, and said second flap having pivot points located in the same substantially horizontal plane.

5. The hydrofoil according to claim 3, further characterized by said first flap, said second flap and said third flap having pivot points at their ends closest to said central portion.

6. The hydrofoil according to claim 5, further characterized by said pivot point of said third flap being located in the area of greatest thickness of the foil.

* * * * *